US005511646A

United States Patent [19]

Maldanis et al.

[11] Patent Number: 5,511,646

[45] Date of Patent: Apr. 30, 1996

[54] MULTIPLE PRICE AND SIZE SETTING METHOD FOR VENDING MACHINES

[75] Inventors: Algert J. Maldanis, Heath, Tex.; David K. Giegerich, Fair Lawn; Andris C. Sloss, Sussex, both of N.J.

[73] Assignee: Rowe International, Inc., Grand Rapids, Mich.

[21] Appl. No.: 71,713

[22] Filed: Jun. 3, 1993

[51] Int. Cl.[6] ..... G07F 11/58

[52] U.S. Cl. ..... 194/217; 221/12; 221/242; 364/479

[58] Field of Search ..... 194/217, 218; 221/2, 5, 12, 76–79, 91, 242; 364/479; 235/381; 312/91, 97

[56] References Cited

U.S. PATENT DOCUMENTS

| | | | |
|---|---|---|---|
| 1,592,069 | 7/1926 | Benson . | |
| 2,493,857 | 1/1950 | Cargill | 198/138 |
| 2,512,356 | 6/1950 | Massiello | 198/138 |
| 2,965,214 | 12/1960 | Schlumpf et al. | 198/25 |
| 3,202,265 | 8/1965 | Anders | 198/158 |
| 3,297,378 | 1/1967 | Krug et al. | 312/223 |
| 3,491,915 | 1/1970 | Gore et al. | 221/76 |
| 3,697,148 | 10/1972 | Weber | 312/91 X |
| 3,902,950 | 9/1975 | Raynor et al. | 198/158 |
| 4,834,231 | 5/1989 | Awane et al. | 194/217 |
| 4,942,290 | 7/1990 | Frerking | 235/381 |

OTHER PUBLICATIONS

Brochure of Rowe International, Inc. "Genesis™. The Look of the Future from Rowe.®".

*Primary Examiner*—F. J. Bartuska

*Attorney, Agent, or Firm*—John W. Montgomery; Ross, Clapp, Korn & Montgomery

[57] ABSTRACT

A programmable size and price-setting mechanism for use in a vending machine has a plurality of n access doors aligned horizontally across a front of the vending machine, each of which access doors has a locked condition denying access therethrough and an unlocked condition allowing access therethrough, and each of which is selectably activatable between the locked and unlocked condition. There are a plurality of horizontal shelves each of which has a plurality of partitionable areas corresponding in size to a corresponding one of the n access doors, such that each shelf is selectably partitionable into a plurality of up to n product holding areas. A conveyor mechanism is provided for selectably moving each horizontal shelf into a vending position adjacent to the access doors so that each one of the n partitionable areas is adjacent to a corresponding one the n access doors. A sensor detects which of the plurality of shelves is positioned adjacent to the plurality of n access doors. A plurality of n actuatable buttons are mounted on the vending machine, each actuatable button adjacent to one of the n access doors. A money-receiving and value detection device is also provided. Programmable control circuitry is operatively connected to the plurality of actuatable buttons, to the shelf position sensor and to the money-receiving and value detection device for activating a selected one or more of the n access doors from the locked to the unlocked condition upon detecting a programmed value of money received, upon detecting a selected one of the plurality of shelves positioned adjacent to the access doors, and upon actuation of one of the actuatable buttons located adjacent to the one or more n access doors through which access to one of the product holding areas is desired.

3 Claims, 4 Drawing Sheets

MULTIPLE PRICE AND SIZE SETTING METHOD FOR VENDING MACHINES

TECHNICAL FIELD OF THE INVENTION

The present invention relates to vending machines by which products of various sizes may be viewed, selected, and vended, upon insertion into the machine of an appropriate amount of money; and in particular, to a vending machine having a plurality of partitionable horizontal shelves on which products of various sizes may be placed, stored, and displayed for vending with a mechanism for movement of the shelves adjacent to a display area and for providing accessibility to a desired selection upon payment of an appropriate purchase price into the vending machine.

BACKGROUND OF THE INVENTION

Previously, vending machines of the type which held and displayed products on horizontal shelves have been constructed with a plurality of vertically stacked trays having a fixed number of partition areas on each tray for holding products to be vended. The horizontal shelves permitted display and vending of products having various shapes and sizes, such as fruit, sandwiches, prepared salads, prepared dinner plates, dairy products in containers, fruit drink cans, or other varieties of items which are not necessarily foodstuffs. At each vertical level, there was an openable door behind which a desired partitioned area could be positioned. Payment of a required fee and selection of a particular product by moving the partitioned area to the door permitted the door to be opened for removing the product.

One such device provided a plurality of rotatable circular trays with a display window and a single openable door at each level. The items could be selected by rotating the tray past the display window until a desired selection was adjacent to the openable door. Payment of the indicated purchase price allowed the door to be opened so that the selected item could be removed. Each separate tray would be partitioned into a plurality of product-holding areas, each the same size as the others. Upon payment of the appropriate price for a product on a given tray, the vending door was openable only to the extent required to reach the product. In this manner, any given tray would be stocked with products of substantially equal size and equal value so that payment of the amount of money indicated for all of the items on a given tray would allow the door to be opened. A degree of variability was accomplished by providing a door with capabilities of pre-setting its opening size. A small opening was set corresponding to small partitioned areas, and a larger opening was set corresponding to larger partitioned areas. Trays at different levels could have different size partitioned areas, but all of the partitioned areas on a single tray had to be the same size. A given tray construction could be variably partitioned to accommodate different sizes, provided the entire tray was partitioned with the same size areas. A single preset opening size was needed for the entire tray at each level.

SUMMARY OF THE INVENTION

The present invention overcomes many of the drawbacks of the prior horizontal shelf vending machine by providing a plurality of vertically movable horizontal shelves carried on a continuous conveyor for maintaining the shelves in a horizontal orientation as they are moved on the conveyor. The conveyor moves the shelf past the display window on the front of the vending machine through which products carried on the shelves may be viewed. A plurality of doors are provided aligned horizontally across the front of the machine at one level, preferably at the bottom of the viewing window. Each door has a locked condition denying access therethrough and an unlocked condition allowing access therethrough, and each door is selectably activatable between the locked and the unlocked condition. The plurality of horizontal shelves are each selectably partitionable into a plurality of product-holding areas. The number n of doors corresponds to the maximum number of areas into which each shelf may be partitioned. Each partitionable area corresponds in size to the size of one of the n access doors. The shelves are alternatively partitionable into larger product-holding areas corresponding in size to a multiple two or more of the smaller product-holding areas. Preferably, each of the n doors and each of the n partitionable areas is the same size. A set of n actuatable buttons are mounted on the vending machine adjacent to the n doors. The buttons are interconnected with programmable control circuitry for actuating one or more of the doors from a locked to an unlocked condition upon pressing an adjacent button. The programmable control circuitry is operatively connected not only to the actuatable buttons, but also to shelf position detection means and to the money value detection means for activating a selected one or more of the n doors from the locked to the unlocked condition only upon detecting the shelf position and the button being actuated and comparing the programmed and stored price for the detected shelf and button to a detected value of money received. If the comparison indicates that the money received is greater than or equal to the programmed price, a signal is produced which is operable to move a selected one or more of the n doors from the locked to the unlocked condition for access to the product-holding area therethrough.

According to another feature of the invention, an electronically controlled visual display is attached to the vending machine adjacent to each of the n doors. The programmable control circuitry is provided with an operation mode and with a programming mode. Means for selecting between the modes may include a key by which the machine is opened for service by an owner or concessionaire of the vending machine. A program keyboard or panel is connected to the programmable control circuitry, to the visual displays, and to the actuatable buttons such that in the program mode actuation of a button adjacent a visual display will permit the operator to set a price, which price will be stored in memory upon actuation of the leftmost button under a partitioned area for which the price is to be set and then actuation of the rightmost button under the partitioned area of the shelf for which the price is being set. The leftmost button and the rightmost button will be the same button in instances where the shelf product area corresponds to only one of the n partitionable areas into which the shelf may be divided. Upon setting prices for each of the shelf product areas, the machine is actuated into its operation mode and the set prices are stored in a memory.

BRIEF DESCRIPTION OF THE DRAWINGS

These and other objects, advantages and features will be more fully understood with reference to the following specifications, claims and drawings in which like numerals represent like elements and in which:

DETAILED DESCRIPTION OF THE PREFERRED EMBODIMENTS

Figure 1:
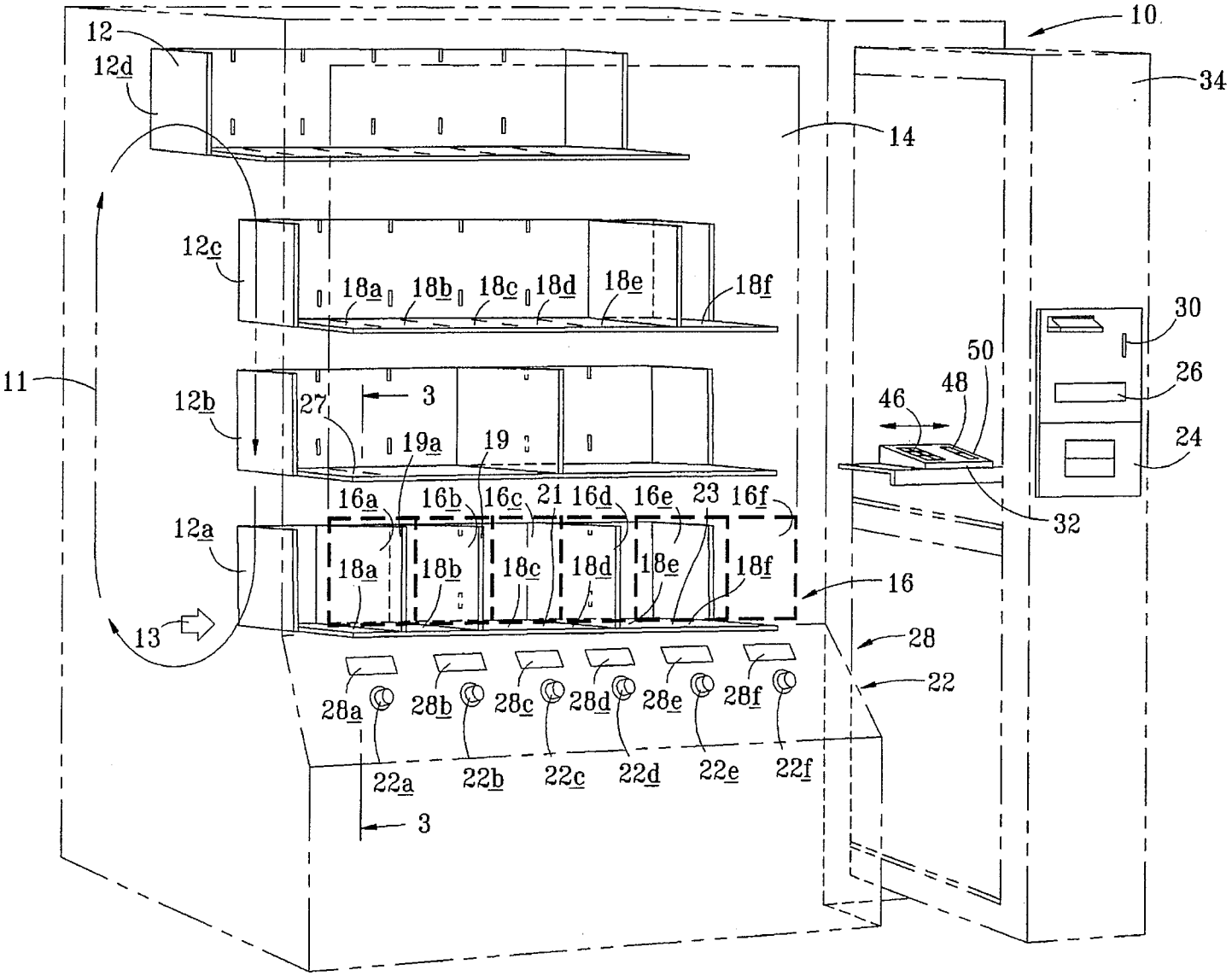
FIG. 1 is a schematic front perspective view of a vending machine with a programmable price-setting mechanism according to the present invention.

FIG. 1 depicts a front perspective view of a vending machine 10 which includes a plurality of horizontal shelves 12 which are movable vertically within the vending machine 10 as with a vertical conveyor means 11 which is schematically depicted with phantom lines in FIG. 1. The conveyor means 11 may advantageously be constructed according to a co-owned co-pending application filed concurrently herewith, entitled "Drive Mechanism for Moving a Horizontal Shelf in a Vending Machine," which application is incorporated by reference as if fully set forth herein. Conveyor means 11, such as a motorized vertically moving shelf mechanism 11 maintains shelves 12 in a horizontal orientation with a portion of the plurality of shelves 12 being moved into viewable position at front window 14 shelf position detector 13 senses the position of the shelves. Preferably, the shelves are moved in a step-wise fashion, such that the operator, whether the consumer or the concessionaire, may move each shelf 12 into alignment with a plurality of n doors, wherein n is an integer number corresponding to the total number of doors. A convention of description will be adopted for purposes of clarity in this application. The leftmost door, when viewed from the front of the vending machine, is designated as the first door 16*a*. The next door 16*b* to the immediate right of the first door is designated as the second door. The next door 16*c* to the right is designated as the third door, 16*d* as the fourth door, 16*e* as the fifth door and 16*f* as the nth door.

Shelves 12 are positionable in vertical alignment with the doors 16. Each shelf 12 is partitionable into n product-holding areas 18 with the first area 18*a* corresponding in location and size to first door 16*a*, second partitionable area 18*b* corresponding in position and size to door 16*b*, and with third partitionable area 18*c* similarly corresponding to door 16*c*, fourth partitionable area 18*d* similarly corresponding to fourth door 16*d*, fifth partitionable area 18*e* similarly corresponding to fifth door 16*e*, and the nth area 18*f* corresponding to the nth door 16*f*. Each partitionable area is selectably partitionable from its next adjacent area with rigidly affixable partitions 19 as depicted for shelf 12*a*, wherein partition 19*a* separates areas 18*a* and 18*b*. The partitionable areas may also be combined with a next adjacent partitionable area to form a larger product-holding area by removing or simply not attaching a partition 19 between two or more adjacent partitionable areas. For example, on shelf 12*a*, areas 18*c* and 18*d* are combined and areas 18*e* and 18*f* are combined into larger product-holding areas 21 and 23, respectively. Some of the wide variety of possible combinations of combined areas are schematically indicated at shelves 12*b*, 12*c* and 12*d*.

In operation, access to a larger product-holding area is provided by opening correspondingly adjacent doors. Thus, if the third area 18*c* and fourth area 18*d* are combined, the resulting product-holding area is accessed by opening both the third 16*c* and fourth 16*d* doors.

In the preferred embodiment, each door 16 and each partitionable area 18 are conveniently formed of the same size as each other door and each other partitionable area so that economies of scale can be obtained in the manufacture of vending machines for a variety of applications. The selectable partitionability of each of the shelves provides substantially unlimited versatility without requiring separately sized doors and shelf areas. However, many of the aspects and advantages of the present invention may be obtained even where each door 16 is separately sized, provided the correspondingly located partitionable areas 18 on each of the shelves 12 are also correspondingly separately sized. All shelves 12 would have similarly sized partitionable areas 18 and access to the combined product-holding areas would be through combined opening of corresponding doors 16.

On the exterior of vending machine 10, vertically aligned with each door 16*a–f* are buttons 22*a–f* which are actuatable for selection of products in each of the partitionable areas 18*a–f*. Through the use of a consumer-control panel 24, shelves 12 may be moved past window 14 sequentially into view through display window 14 until a desired product is observed by the consumer. The consumer then moves the shelf on which the desired product is held into alignment with the access doors 16. The price of the item or desired product in each of the areas 18*a–f* will be displayed to the consumer. For example, the price may be displayed at main display 26 upon depressing an aligned button 22*a–f*. More preferably, the price will be automatically displayed at individual price displays 28*a–f*, which are affixed to the vending machine in alignment with the partitionable areas 18*a–f* and corresponding access doors 16*a–f* and buttons 22*a–f*. Upon depositing or inserting an amount of money equal to or greater than the price of an item, actuation of a button 22*a–f* will open corresponding access doors 16*a–f*. Thus, in the embodiment shown, with shelf 12*a* in the vending position adjacent doors 16, payment of the amount of money indicated at 28*a* and depressing or pushing button 22*a* will open door 16*a* for access into item holding area 18*a*. If the desired item is in the combined product-holding area 21, formed from partitionable areas 18*c* and 18*d*, payment of the price indicated at 28*c* and depressing either button 22*c* or 22*d* will actuate both doors 16*c* and 16*d* from their locked closed position to their unlocked open position. The price of the item in combined area 18*c* and 18*d* may also be indicated at price display 28*d*. Preferably, in order to avoid confusion, 28*d* will be provided with a blank screen or a screen with indicia indicating that the price information should be obtained elsewhere. By way of example but not limitation, dashed lines, zeros or the like characters may be displayed in area 28*d*.

Also schematically depicted in FIG. 1, is a program input panel 32 which becomes accessible only when the vending machine 10 is placed in a "service mode" such as by unlocking a control panel drawer 34, which control panel drawer 34 may be a universal pull-out drawer according to a concurrently filed co-pending and co-owned patent application entitled "Universal Pull-Out Drawer for Vending Machines" which is incorporated herein by reference as if fully set forth. The program input panel 32 is desirably positioned for convenient access by a concessionaire from in front of the vending machine while the concessionaire is filling the product-holding areas 18. Preferably in this position, both the plurality of buttons 22 and the consumer-control panel 24 will be easily accessible and also both the main display 26 and item displays 28 will be easily viewable. The concessionaire can selectably arrange partitions 19 to obtain desired concession areas 18 or combinations thereof. The concessionaire can fill the partitioned areas 18 with appropriately vendable products directly through access doors 16 which will be preferably open with the vending machine in its service mode. The price of the item in each of the partitioned areas 18*a–f* can be maintained as previously set or reprogrammed as desired by the concessionaire.

Figure 2:
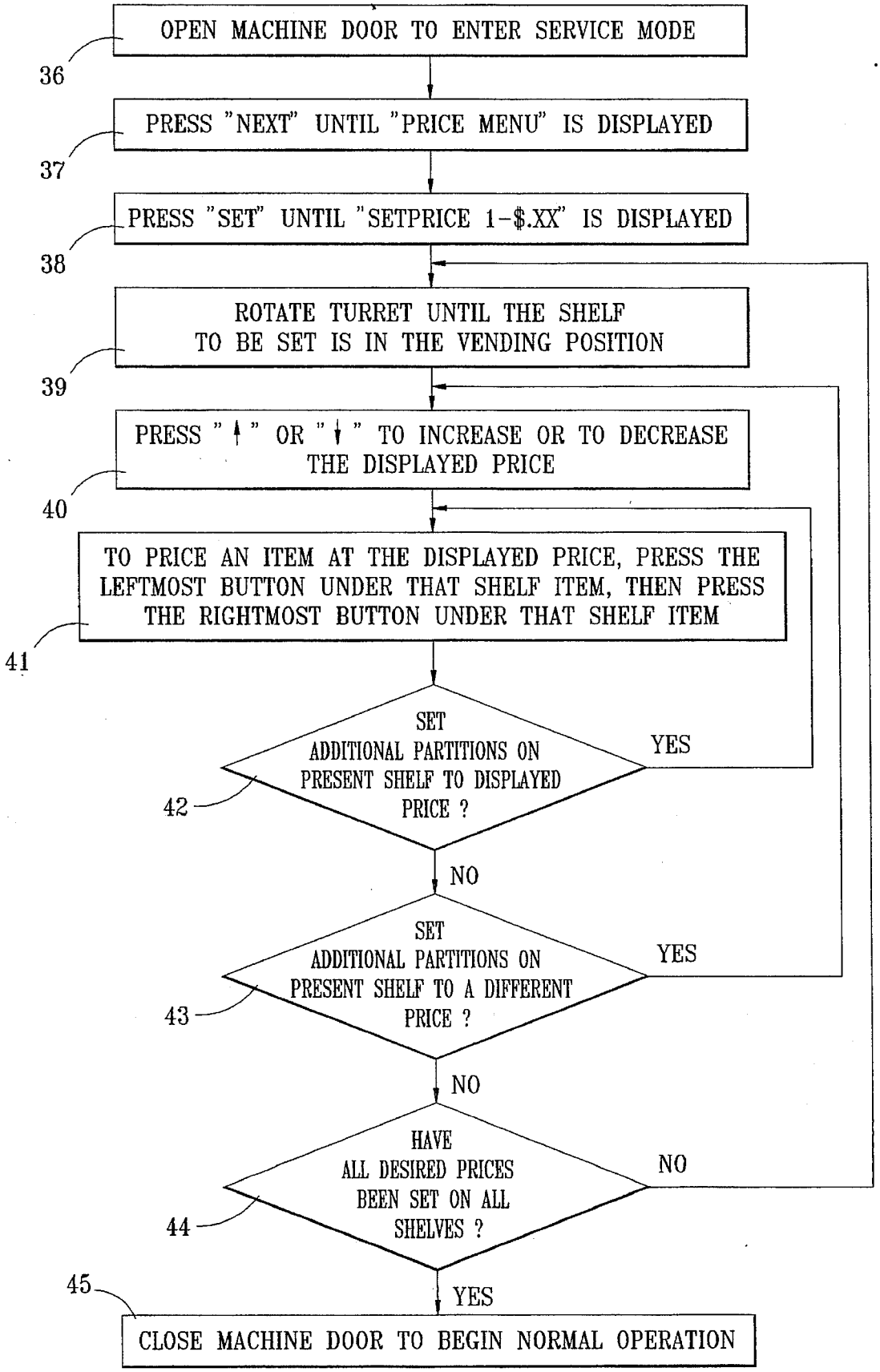
FIG. 2 is a schematic block diagram of programmable control circuitry and method of size and price setting according to the present invention.

FIG. 2 depicts a schematic block diagram of circuitry and its method of use for selectably programming the price of the item for which the appropriate size product-holding area has been selected through partitioning the shelves. First, the vending machine is placed in a service mode as by opening pull-out drawer 34 as indicated at block 36. Next, the input panel 32 is operated to call up a price menu display at main display 26 as indicated at block 37. From a price menu display, a price setting option is selected as at block 38. The conveyor mechanism 11 is then operated using control panel 24 until the desired shelf 12 for which prices are to be set is in the vending position adjacent doors 16 as indicated at block 39. The position is sensed with detector 13. A desired price is then input at input panel 32 and then displayed at main display 26 as indicated at block 40.

For example, referring to FIGS. 1 and 2, the desired price may be input directly through a numeric key pad 46 on input panel 32. Advantageously, the desired price may be input by incrementally increasing or decreasing the price with increase button 48 or decrease button 50 on control panel 32. The size of the incremental price change may be selected in another program mode (as at block 40 of FIG. 2) to conform to the smallest coin denomination accepted by the vending machine. The input price for a selected item may be set (as at block 41 of FIG. 2) for a particular shelf and particular product-holding area by pressing the leftmost button 22 which is aligned with the desired product-holding area and then subsequently depressing the rightmost button under the product-holding area for which the price is to be set. Thus, for example, in the case of shelf 12*a* and product-holding area 18*a*, a price indicated at display 26 will be established by pressing button 22*a* twice. The set price will then be displayed at item price display 28*a*. The set price will be stored in memory and will be displayed each time shelf 12*a* is in the vending position shown in FIG. 1. The same price may be set (as at inquiry block 42) for area 18*b* by simply pressing button 22*b* two times, or alternatively, a different price may be set (as at inquiry block 43) by referring back to step 40. A new price is input through input panel 32 and then set by depressing 22*b* two times.

In order to set the price for a combined product-holding area 21, such as that resulting from 18*c* and 18*d*, a price is input and displayed at display 26. The displayed price is set by depressing the leftmost button 22*c*, which is adjacent that area and then depressing the rightmost button 22*d* for that combined area 18*c* and 18*d*. Similarly, the same or a different price may be set for combined area 23 formed from partitionable areas 18*e* and 18*f* by establishing the desired price at display 26 and then depressing button 22*e* one time and then 22*f* one time. The set prices will remain changeable as long as shelf 12*a* is in the vending position. Thus, if a mistake is made or an erroneous price is entered, the concessionaire merely inputs an appropriate price which will be displayed at main panel 26 and then the concessionaire depresses the leftmost and then the rightmost buttons 22 in sequence. Upon movement of the shelf 12*a* from its vending position, the set prices become stored in memory registers specifically corresponding to the shelf 12 and to corresponding buttons 22 which were depressed. The concessionaire can then move another shelf, to be programmed or for which prices are to be set into the vending position adjacent to doors 16. For example, pushing a down button on consumer control panel 24 will move shelf 12*b* into alignment with access doors 16. For shelf 12*b* as shown in FIG. 1, the price would be set for combined areas 18*a*, 18*b* and 18*c* by establishing a desired price with input panel 32, which price would be displayed at display 26. Depressing the leftmost button 22*a* and then the rightmost button 22*c* sets the price and correspondingly sets the size of the shelf. When the price is set for a product-holding area using the leftmost and the rightmost buttons, the size of the access opening is also set. All of the doors 16*a*, 16*b* and 16*c* will become programmed for opening in the operation mode.

The designation of the size of the access to the product-holding area of a shelf results from the same sequence of leftmost and rightmost buttons. This information is stored and is used in the operation mode in order to open the appropriate doors 16 corresponding to the product-holding area. Thus, referring again to FIG. 1, actuation of button 22*a* will only open door 16*a*. Doors 16*b–f* will remain in a locked closed position. However, actuation of button 22*c* will open both doors 16*c* and 16*d* for access to the combined area 21 formed of unit areas 18*c* and 18*d*. Preferably, actuation of button 22*d* will also open both doors 26*c* and 26*d* for the convenience of the consumer. Likewise, when the vending machine is in its operation mode and shelf 12*b* is moved by the operator into alignment with doors 16, the previously described programming of both the price and the size of the combined product-holding area 27 formed of areas 18*a–c* uses only buttons 22*a* and 22*c*, but acts to enable all of doors 16*a–c*. All of doors 16*a–*16*c* are unlocked upon depressing any of buttons 22*a–*22*c* and, of course, upon payment of the indicated purchase price which is accepted in money acceptance and value indicating device 30. As at block 44, when all of the items in shelf-holding areas have been priced, closing the vending machine door will begin normal operation as at 45.

Figure 3:
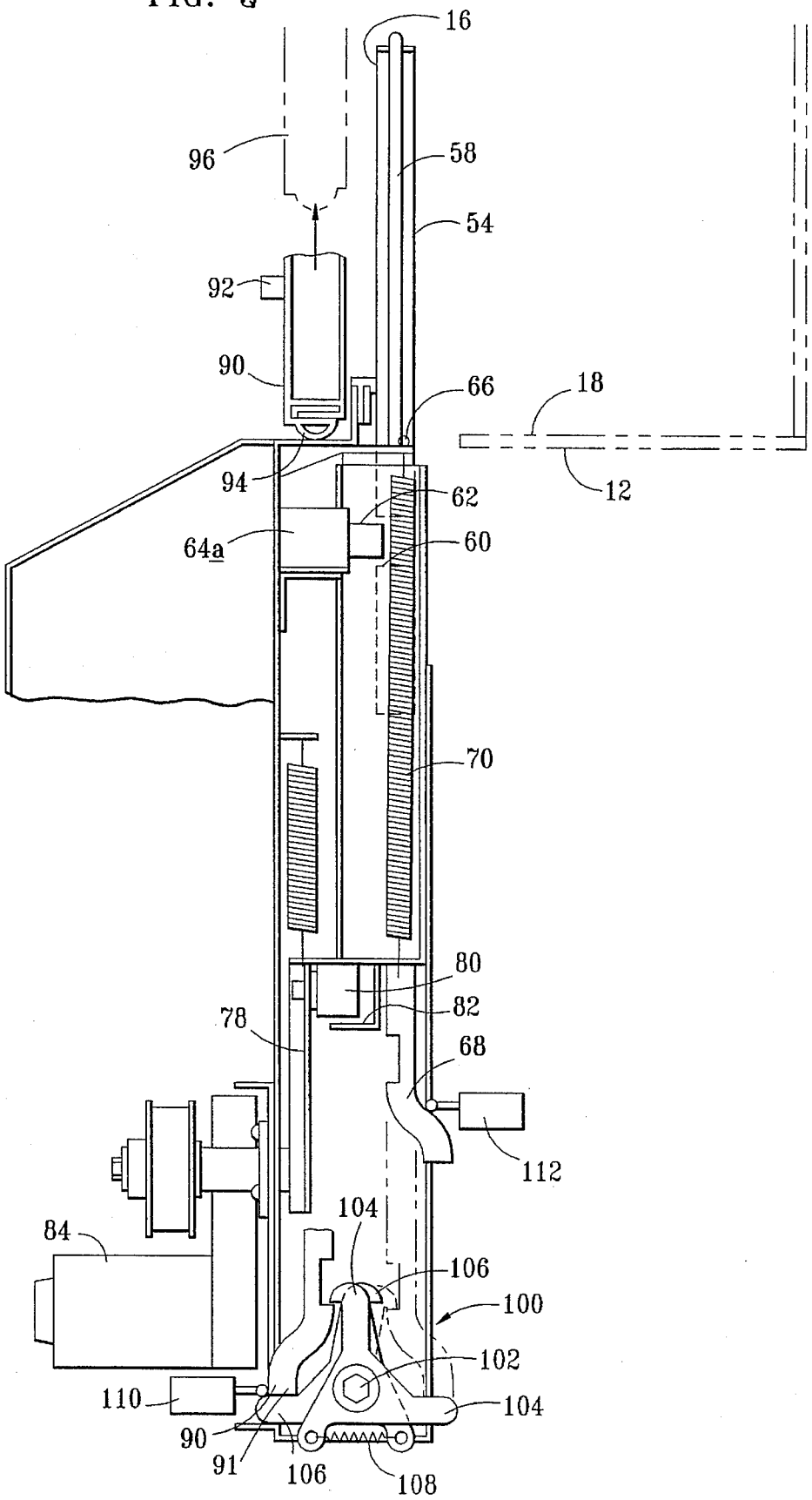
FIG. 3 is a detail cross-sectional view taken along line 3—3 of FIG. 1 of a means for activating a plurality of access doors between a locked condition and an unlocked condition and of a slidable consumer-operated vending door with security and safety features according to the present invention.
Figure 4:
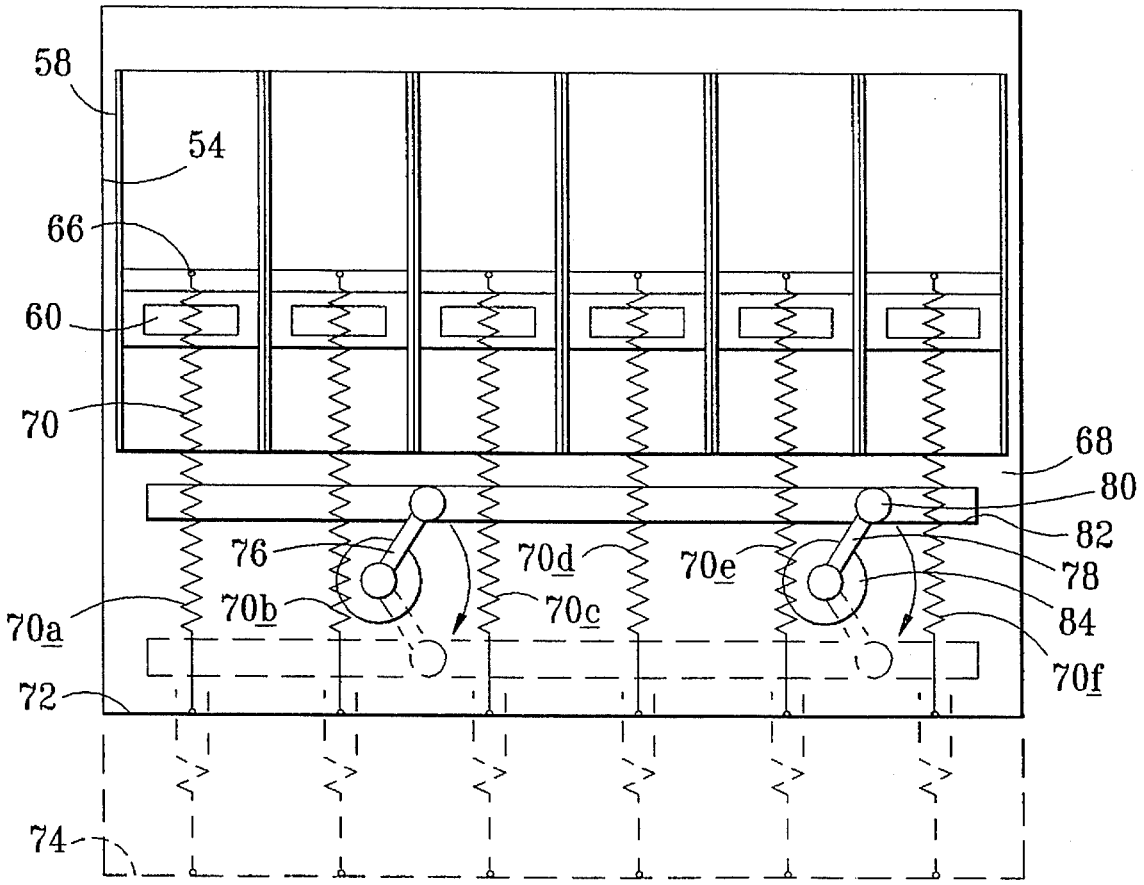
FIG. 4 is a schematic front view of the detail cross-sectional view of FIG. 3.

The details of the mechanical operation of the doors 16*a–f* may be seen with reference to FIG. 3, which is a detailed partial cross-section view of the mechanism for opening doors 16*a–f*, and also with reference to FIG. 4, which is a partial front view of the mechanism shown in FIG. 3. Each of doors 16*a–f* is preferably composed of a durable, clear plastic material which acts as a window through which the product-holding shelf can be viewed. Each door 16 is mounted within vertical slides 54 on either side of the doors and each door has, along its opposite sides, slides 58 correspondingly engaged with slide framework 54. Within each sheet of durable plastic, an orifice 60 is formed through which an electromechanically operated engaging lock 62 is selectably insertable or retractable. Inserting engaging lock 62 into orifice 60 locks the corresponding door 16 in its closed position. For example, engaging mechanism 62 may be spring-loaded into a locked position with independent solenoids 64*a* (and 64*b–f*) selectably operable to disengage a selected mechanism 64*a* (and 62*b–f*) 62*a–f* against a spring bias holding it into the locked position. At a connector 66, each door 16 is connected to a cam-operated carriage 68 through a tension spring 70. Cam-operated carriage 68 is actuatable from a closed position shown at 72 to an open position shown at 74 so that spring tension in springs 70 is completely released with the carriage 68 in the upward or closed door position 72 and spring tension is placed in each of springs 70*a–f* when the carriage 68 is moved to an open door position 74. One or more rotary cams 76 and 78, with roller ends 80 engaged in a linear channel 82, can be actuated from an open to a closed position upon rotating actuation motor 84 180° in a step-wise fashion.

Adjacent to lockable access door 16 is a manually operated vending door 90, which is preferably a vertically sliding door 90. Sliding door 90 is manually liftable, as with handle 92, from its indicated closed position 94 to an upward lifted position 96. With door 90 in upward position 96, the consumer may reach through any of the openings left by any of the retracted access doors 16*a–f*.

The security and safety mechanism for a sliding vending door 90 according to the present invention is schematically depicted in the front view of FIG. 4 and the corresponding side view of FIG. 3. A bi-directional safety locking mechanism 100 is pivotably secured to the vending machine at pivot 102. Reverse direction locking arms 104 and 106 are spring-loaded at 108 toward a completely locked condition. In the locked condition, both tops of both arms 104 and 106 are pushed inwardly with respect to each other and out of engagement with a lower extion 91 of door 90 and out of engagement with carriage 68. When carriage 68 is moved into its down or access door open position, engaging arm 104 is positively moved so that lower extension 91 of door 90 is released and door 90 may be moved to an openable position. Upon moving door 90 to an open position, arm 106 is pivoted into a carriage lock position. This prevents the carriage from being actuated to a closed position while a consumer can reach his or her hand through an opening left by retracted door 16. When the door 90 is closed, then carriage connection arm 106 is pushed downward into a carriage release position and actuation of the carriage motor will move the doors closed. Once the carriage door moves to a closed position, then slidding door 90 becomes engaged with arm 104 until carriage 68 is again actuated to an open position.

Also provided for contact by the sliding door 90 are switches 110 and 112. Switch 110 operates to electrically deactivate the carriage motor 84 and also electrically deactivates conveyor means 11 when slidding door 90 is moved away from its completely down or closed position 94. Switch 112 similarly electrically deactivates the conveyor means 11, by which the horizontal shelves 12 are moved to a vending position, when carriage 68 is moved to its open position 82. Both switches 110 and 112 reactivate the conveyor means 11 and the carriage actuation motor 84 when slidding door 90 is in its closed position 94 and the carriage 68 moves to its closed position 84. In this manner, the consumer-operated slidding door 90 and cam-actuated carriage 68 for actuating the individual access door 16 are provided with an electrical safety system which requires the slidding door to be in its totally closed position before the carriage will close access doors 16. The safety system also prevents movement of shelves so that the risk of hands trapped within the product-holding area when either the doors 16 close or the shelves 12 move, is eliminated, both electrically and mechanically.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A method of programming size and price settings for a vending machine comprising the steps of:

(a) placing said vending machine in a programming mode;

(b) moving a desired horizontal shelf to a vending position, which shelf has a product-holding area;

(c) inputting a desired price on a visual display;

(d) actuating a button corresponding to a leftmost button adjacent to said product-holding area and subsequently actuating a rightmost button adjacent to said product-holding area to set said desired price and size for said product-holding area; and (e) taking said machine out of said programming mode to store said price for product-holding area and to place said vending machine into an operating condition.

2. A method of programming as in claim 1 further comprising the step of setting a same desired price for multiple price holding areas on said horizontal shelf before moving another horizontal shelf to a vending position.

3. A method of programming as in claim 2 further comprising the steps of:

(a) inputting a corrected price on said visual display without moving said other horizontal shelf to a vending position; and (b) actuating said leftmost actuation button and then actuating said rightmost actuation button adjacent to said product holding area in sequence for setting said corrected price for said product-holding area.

* * * * *

UNITED STATES PATENT AND TRADEMARK OFFICE

CERTIFICATE OF CORRECTION

PATENT NO. : 5,511,646

DATED : April 30, 1996

INVENTOR(S) : Algert J. Maldanis, et al.

It is certified that error appears in the above-identified patent and that said Letters Patent is hereby corrected as shown below:

Column 3, Line 28:

Immediately following "window 14", insert -- . A --.

Column 6, Line 59:

Replace "64a (and 62b-f) 62a-f against" with -- 62a (and 62b-f) against --.

Column 7, Lines 34, 40 & 47:

Replace "slidding" with -- sliding --.

Column 8, Lines 1 & 4:

Replace "slidding" with -- sliding --.

Signed and Sealed this

Sixth Day of August, 1996

*Attest:*

Bruce Lehman

BRUCE LEHMAN

*Attesting Officer*

*Commissioner of Patents and Trademarks*